US006966126B2

(12) United States Patent
Baurmann

(10) Patent No.: US 6,966,126 B2
(45) Date of Patent: Nov. 22, 2005

(54) LAUNDRY DRIER WITH REMOVABLE FILTER

(75) Inventor: Martin Baurmann, Berlin (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 28 days.

(21) Appl. No.: 10/200,637

(22) Filed: Jul. 22, 2002

(65) Prior Publication Data

US 2003/0014880 A1 Jan. 23, 2003

(30) Foreign Application Priority Data

Jul. 20, 2001 (DE) ..... 101 35 471

(51) Int. Cl.[7] ..... F26B 3/00
(52) U.S. Cl. ..... 34/606; 34/235; 34/82; 34/480; 34/86
(58) Field of Search ..... 34/606, 235, 82, 34/480, 603, 202, 595, 86; 95/279; 454/158; 96/233; 55/385.1, 482

(56) References Cited

U.S. PATENT DOCUMENTS

| | | | | |
|---|---|---|---|---|
| 4,395,831 A * | 8/1983 | Nielsen | 34/86 |
| 5,215,718 A * | 6/1993 | Katzer et al. | 422/102 |
| 5,369,892 A * | 12/1994 | Dhaemers | 34/275 |
| 5,713,137 A * | 2/1998 | Fujita | 34/106 |
| 2003/0089239 A1 | 5/2003 | Moschütz | |

FOREIGN PATENT DOCUMENTS

| | | | |
|---|---|---|---|
| DE | 197 05 616 A1 | 8/1998 | |
| DE | 199 35 984 A1 | 2/2001 | |
| DE | 100 29 428 A1 | 1/2002 | |
| GB | 2 091 123 A | 7/1982 | |
| JP | 11-300096 A | 11/1999 | |
| NL | 0608034 A1 * | 1/1994 | B60H 3/06 |
| WO | WO 01/96648 A1 | 12/2001 | |

* cited by examiner

*Primary Examiner*—Kenneth Rinehart
(74) *Attorney, Agent, or Firm*—John T. Winburn; Russell W. Warnock; Craig J. Loest

(57) ABSTRACT

A laundry drier includes a filter is disposed removably in the air duct carrying the process air and is held in an at least two-part foldable frame. To extend its functionality with a view to the binding of odors from the laundry items, the filter contains a charcoal-fiber insert that is equipped to combine and/or convert odorous substances.

20 Claims, 1 Drawing Sheet

LAUNDRY DRIER WITH REMOVABLE FILTER

BACKGROUND OF THE INVENTION

Field of the Invention

The invention relates to a laundry drier with a removable filter that is disposed in the airflow and that is held in an at least two-part foldable frame.

German Published, Non-Prosecuted Patent Application DE 197 05 616 A1 discloses a lint filter device for a laundry drier, in which a first lint screen, a coarse lint filter, is followed by a second finer deep-bed filter that can be extracted from the lint filter device and can be cleaned under running water. The deep-bed filter is of foam and, therefore, has to be cleaned carefully. Furthermore, the action of the deep-bed filter amounts to nothing more than an improved filter action with respect to the lint entrained in the airflow.

SUMMARY OF THE INVENTION

It is accordingly an object of the invention to provide a laundry drier with removable filter that overcomes the hereinafore-mentioned disadvantages of the heretofore-known devices of this general type and that has an air filter with extended functionality, for which cleanability is not of such importance when a conventional fine lint filter precedes the air filter in a direction of the airflow.

With the foregoing and other objects in view, there is provided, in accordance with the invention, a laundry drier, including a laundry holding chamber, an airflow duct fluidically connected to the chamber for supplying an airflow to the chamber, an at least two-part foldable frame at least partially disposed in the airflow duct, and a removable filter held in the frame and disposed in the airflow duct, the filter having an insert at least one of binding and converting odorous substances in the airflow.

With the objects of the invention in view, there is also provided an airflow duct filter for a laundry drier having an airflow duct for conveying an airflow, including an at least two-part foldable frame to be at least partially disposed in the airflow duct of the laundry drier and a removable filter element held in the frame, the filter element to be disposed in the airflow duct, the filter element having an insert at least one of binding and converting odorous substances in the airflow.

According to the invention, the filter contains an insert binding and/or converting odorous substances. The material active for odorous substances may be, for example, activated charcoal and ensures that the airflow is thoroughly cleansed of odorous substances. Odorous substances that originate from laundry items in the treatment space of the laundry drier are bound or converted in the odor-binding insert. The air returning to the treatment space of the laundry drier or the air sucked in again from the surroundings is free of such odorous substances and releases the odorous substances to be removed out of the laundry items by transporting these substances to the odor-binding insert of the filter device. As such, the odorous substance fraction in the laundry items can be reduced within a relatively short period of time to such an extent that there is no longer any odor nuisance.

In accordance with another feature of the invention, the insert binding and/or converting odorous substances may be of a sheet-like piece of fibrous nonwoven, fibrous woven fabric, or fibrous knitted fabric, the fibers of which are provided with a covering binding and/or converting odorous substances. In the case of an appropriately durable covering, it is even possible for the odorous substances to be washed out of the fibrous material again. Such a covering may be of activated charcoal or other minerals that bind and/or convert odorous substances. A treatment of the fibrous material with catalytically active substances that can decompose odorous substances may also be advantageous.

The insert should have, as far as possible, no hard components, so that it can be washed in exactly the same way as normal laundry in a household washing machine, without the risk of the washing machine being damaged.

In accordance with a further feature of the invention, the filter may be of a sheet-like piece of fibrous nonwoven, fibrous woven fabric, or fibrous knitted fabric, the fibers of which are provided with a covering that is active with respect to odorous substances. In such a case, either the covering may be of activated charcoal or the entire insert itself may be of an activated-charcoal fibrous material.

In accordance with an added feature of the invention, advantageously, the laundry drier has a receptacle for holding and tensioning the insert within the airflow. The insert may, in such a case, be of a portion of a filter material capable of being manufactured in band form and thereby be made available in a very cost-effective way.

In accordance with an additional feature of the invention, the receptacle for the insert is advantageously removable from the household appliance to make it easier for the insert to be introduced and extracted. For such a purpose, it is particularly advantageous if the receptacle has a frame with a crossed-rib structure and a mesh-shaped holder for the insert, the meshes of which have the same spacing dimensions as the crossed-rib structure.

In accordance with yet another feature of the invention, the frame can be removed from the airflow duct.

In accordance with yet a further feature of the invention, the insert may be preceded by a fine filter for the removal of particles, preferably, of lint, from the airflow. The insert can, thus, be protected against contamination by fine particles that could clog it or impair its action.

Advantageously, the invention is employed in a condensation-type laundry drier, in which process air is circulated in a closed circuit and in the process-air circuit of which are disposed a heating device for warming the process air, a cooling device for cooling process air laden with moisture, the insert, and a preceding lint filter as a fine filter. In such an application, account can be taken of a frequent need of the users that is aimed at freeing the laundry of unpleasant odor substances. Such may be the case when the article of clothing has been exposed to cigarette smoke and only airing of the article of clothing is required. The odor filter is advantageously disposed, within the process-air circuit, at the point at which the best conditions for removing the odorous substances from the process air prevail.

Thus, for example, in the section between the cooling device and the heating device, the temperature of the process air is the lowest and the relative air humidity is the highest, and, downstream of the heating device and before contact with the laundry to be dried, the temperature is the highest and the relative air humidity is the lowest.

In accordance with yet an added feature of the invention, there is provided a blower disposed in the airflow duct, the laundry holding chamber, the airflow duct, and the blower forming a condensation-type laundry drier circulating the airflow in a closed airflow circuit. There are also provided a heating device is disposed in the airflow circuit for warming the airflow, a cooling device disposed in the airflow circuit for cooling the airflow laden with moisture, the insert being disposed in the airflow circuit, and a lint filter disposed in the airflow circuit upstream of the insert with respect to a direction of the airflow.

In accordance with a concomitant feature of the invention, a control device of the condensation-type laundry drier may advantageously be set up such that the process air can be warmed to a temperature below the temperature conventionally used for laundry drying and can be circulated. Thus, the laundry can be treated more carefully and, nevertheless, aired, while energy can also be saved due to the reduced temperature. Furthermore, the control device may be set up such that the process air can be circulated even when the cooling device is switched off. Cooling of the process air is not necessary during airing because there is no moisture to be removed from the process air and, therefore, further energy can be saved.

Other features that are considered as characteristic for the invention are set forth in the appended claims.

Although the invention is illustrated and described herein as embodied in a laundry drier with removable filter, it is, nevertheless, not intended to be limited to the details shown because various modifications and structural changes may be made therein without departing from the spirit of the invention and within the scope and range of equivalents of the claims.

The construction and method of operation of the invention, however, together with additional objects and advantages thereof, will be best understood from the following description of specific embodiments when read in connection with the accompanying drawings.

DESCRIPTION OF THE PREFERRED EMBODIMENTS

Figure 1:
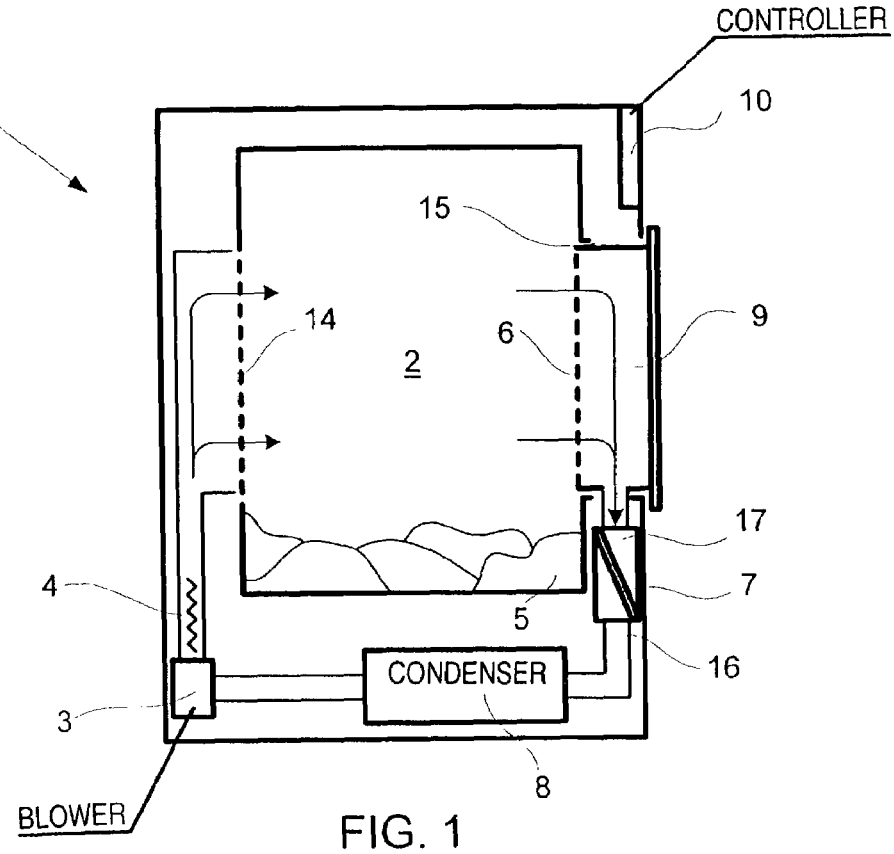
FIG. 1 is a diagrammatic cross-sectional view of a laundry drier according to the invention.

Referring now to the figures of the drawings in detail and first, particularly to FIG. 1 thereof, there is shown a household laundry drier 1 with a rotatably mounted drum 2 for receiving the laundry 5 to be dried. The drum 2 has a perforated drum bottom 14 and, on the opposite end face, a loading orifice 15 that can be closed by a door 9 articulated on the housing of the household laundry drier 1. During operation, a blower 3 generates a dry-airflow that is conducted to a heating device 4 and subsequently through the perforated drum bottom 14 into the drum 2. After contact with the laundry 5, the dry airflows first through a coarse lint filter 6 in the door 9 and subsequently through a fine filter, not illustrated in any more detail, mounted in a housing 17 along the process-air duct 16 and through the insert 13 (see FIGS. 2 and 3), held in a receptacle 7, as an odor filter. The dry air is subsequently conducted to a condenser 8, in which the dry air is cooled in order to condense laundry moisture contained therein. For such a purpose, the condenser 8 has flowing through it cooling air that is sucked in from the surroundings of the household laundry drier 1. After flowing through the condenser 8, the dry air is sucked in again by the blower 3.

Figure 2:
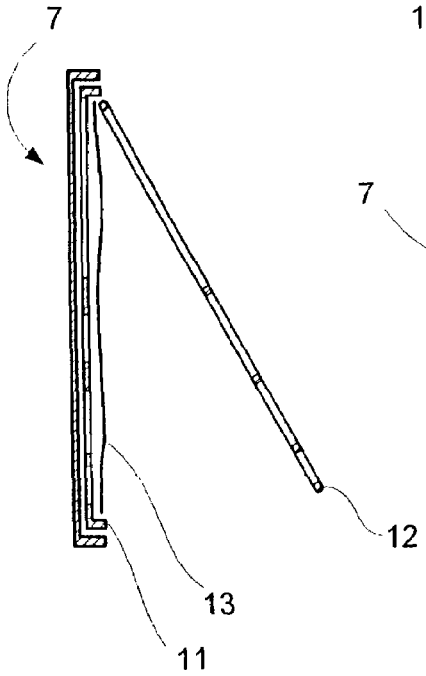
FIG. 2 is a cross-sectional view for the receptacle of the insert of FIG. 1 along section line II—II in FIG. 3.
Figure 3:
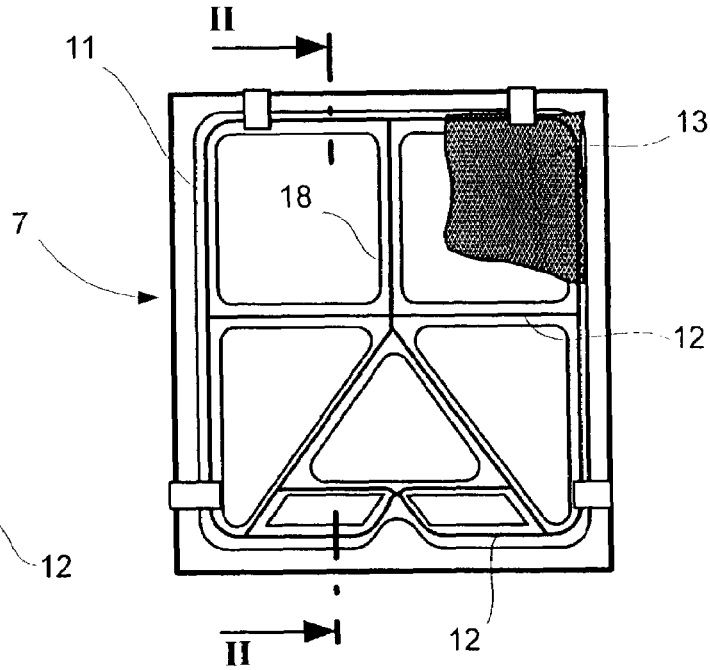
FIG. 3 is a partially fragmentary plan view of the receptacle and insert according to the invention.

The receptacle 7, illustrated in FIG. 2 in cross-section and in FIG. 3 in a plan view showing the surface of the insert 13, serves as a holding frame for the odor filter 13. For such a purpose, the holding frame 7 receives a sheet-like dish-shaped frame 11, the bottom of which, as a crossed-rib structure 18, has large orifices for the passage of the process air. A foldable holder 12 is interlocked in the frame 11. The holder 12 may be of a high-grade steel wire mount. Its meshes have a width comparable to that of the orifices of the crossed-rib structure 18. As a result, although the holder 12 covers substantially the entire bottom of the frame 11, nevertheless, in the folded-down state, its orifices are congruent with the orifices in the frame 11. An odor filter 13 in the form of a piece of nonwoven or textile material is retained (illustrated only partially in FIG. 3) between the frame 11 and the holder 12.

To produce the odor-binding property, the nonwoven-like or textile-like odor filter 13 is treated or covered with a substance (for example, activated charcoal) that can bind odorous substances. Preferably, the odorous substances can also be washed out of the insert 13 again to regenerate the odor-binding property and, thus, keep it suitable for permanent use. The insert 13, therefore, has no hard components of any kind and can, therefore, be washed in a washing machine in the same way as conventional laundry.

The holding frame 7 can be extracted from the process-air duct 16 of the laundry drier 1 from outside, in particular, through a non-illustrated flap in the housing of the laundry drier 1 or through the supply-air orifice in the loading orifice 15 to the process-air duct 16. The holder 12 and the frame 11 may also remain in the laundry drier if the insert 13 is accessible when the holding frame 7 is inserted. Furthermore, the insert 13 may also be connected firmly to the holder 12 or to the frame 11 and be removable together therewith.

The laundry drier illustrated in FIG. 1 has a control device 10 for activating the blower 3, the heating device 4, and a further non-illustrated blower that supplies the condenser 8 with cooling air. The control device 10 is set up such that, in a program for airing the laundry 5, the process air can be circulated at a reduced temperature and during the rotation of the drum 2, the blower for the condenser 8 being switched off, so as not to cool down the process air unnecessarily. In such a case, contrary to a normal drying program, in addition to the temperature of the process air or the heating capacity of the heating device 4, the movement of the laundry drum 2 may also be reduced.

I claim:

1. A laundry drier, comprising:

a laundry holding chamber;

an airflow duct fluidically connected to said chamber for supplying an airflow to said chamber;

an at least two-part foldable frame at least partially disposed in said airflow duct, said frame including a cross-ribbed structure having given dimensions;

a removable filter held in said frame and disposed in said airflow duct, said filter having an insert at least one of binding and converting odorous substances in the airflow;

said frame having a mesh-shaped holder for holding said insert against said cross-rib structure, said mesh-shaped holder having dimensions equal to said given dimensions of said ribbed structure;

said insert has a substance at least one of binding and converting odorous substances; and said substance is activated charcoal.

2. The laundry drier according to claim 1, wherein:

said insert is a sheet of one of the group consisting of a fibrous nonwoven, a fibrous woven fabric, and a fibrous knitted fabric; and said sheet has fibers with a covering active with respect to odorous substances.

3. The laundry drier according to claim 2, wherein said covering includes activated charcoal for at least one of binding and converting odorous substances.

4. The laundry drier according to claim 2, wherein said covering is of activated charcoal for at least one of binding and converting odorous substances.

5. The laundry drier according to claim 1, wherein said insert is of one of the group consisting of an activated charcoal fibrous nonwoven, an activated charcoal fibrous woven fabric, and an activated charcoal fibrous knitted fabric.

6. The laundry drier according to claim 1, wherein said frame has a receptacle for holding and tensioning said insert within the airflow.

7. The laundry drier according to claim 1, wherein said frame can be removed from said airflow duct.

8. The laundry drier according to claim 1, including a fine filter for removal of particles from the airflow, said fine filter being disposed upstream of said insert with respect to a direction of the airflow.

9. The laundry drier according to claim 1, wherein:

a blower is disposed in said airflow duct;

said laundry holding chamber, said airflow duct, and said blower form a condensation-type laundry drier circulating the airflow in a closed airflow circuit;

a heating device is disposed in said airflow circuit for warming the airflow;

a cooling device is disposed in said airflow circuit for cooling the airflow laden with moisture;

said insert is disposed in said airflow circuit; and a lint filter is disposed in said airflow circuit upstream of said insert with respect to a direction of the airflow.

10. The laundry drier according to claim 9, including a control device connected to said heating device and to said blower, said control device programmed to warm the airflow to a temperature below a temperature conventionally used for laundry drying and to circulate the airflow in said airflow circuit.

11. The laundry drier according to claim 10, wherein said control device is connected to said cooling device and is programmed to circulated the airflow in said airflow circuit when said cooling device is switched off.

12. An airflow duct filter for a laundry drier having an airflow duct for conveying an airflow, comprising:

an at least two-part foldable frame to be at least partially disposed in the airflow duct of the laundry drier, said frame including a cross-ribbed structure having given dimensions;

a removable filter element held in said frame, said filter element to be disposed in the airflow duct, said filter element having an insert at least one of binding and converting odorous substances in the airflow;

said frame having a mesh-shaped holder for holding said insert against said crossed-rib structure, said mesh-shaped holder having dimensions equal to said given dimensions of said ribbed structure;

said insert has a substance at least one of binding and converting odorous substances; and said substance is activated charcoal.

13. The filter according to claim 12, wherein:

said frame has a body and a door; and said filter element is removably held between said body and said door.

14. The filter according to claim 12, wherein:

said insert is a sheet of one of the group consisting of a fibrous nonwoven, a fibrous woven fabric, and a fibrous knitted fabric; and said sheet has fibers with a covering active with respect to odorous substances.

15. The filter according to claim 14, wherein said covering includes activated charcoal for at least one of binding and converting odorous substances.

16. The filter according to claim 14, wherein said covering is of activated charcoal for at least one of binding and converting odorous substances.

17. The filter according to claim 12, wherein said insert is of one of the group consisting of an activated charcoal fibrous nonwoven, an activated charcoal fibrous woven fabric, and an activated charcoal fibrous knitted fabric.

18. The filter according to claim 12, wherein said frame has a receptacle for holding and tensioning said insert within the airflow.

19. The filter according to claim 12, wherein said frame is to be disposed downstream of a fine filter for removing particles from the airflow with respect to a direction of the airflow.

20. The filter according to claim 12, wherein the airflow duct filter is for a condensation-type laundry drier and is to be disposed in a closed airflow circuit.

* * * * *